US011594206B2

(12) United States Patent
Hirose et al.

(10) Patent No.: US 11,594,206 B2
(45) Date of Patent: Feb. 28, 2023

(54) ELECTRONIC WIND INSTRUMENT AND CONTROL METHOD THEREOF

(71) Applicant: Roland Corporation, Shizuoka (JP)

(72) Inventors: Masakazu Hirose, Shizuoka (JP); Yuji Terada, Shizuoka (JP)

(73) Assignee: Roland Corporation, Shizuoka (JP)

( * ) Notice: Subject to any disclaimer, the term of this patent is extended or adjusted under 35 U.S.C. 154(b) by 280 days.

(21) Appl. No.: 17/001,687

(22) Filed: Aug. 25, 2020

(65) Prior Publication Data

US 2021/0074252 A1 Mar. 11, 2021

(30) Foreign Application Priority Data

Sep. 6, 2019 (JP) ..... JP2019-163296

(51) Int. Cl.
*G10H 1/053* (2006.01)

(52) U.S. Cl.
CPC ..... *G10H 1/053* (2013.01); *G10H 2220/361* (2013.01); *G10H 2230/175* (2013.01); *G10H 2230/195* (2013.01); *G10H 2230/241* (2013.01); *G10H 2250/461* (2013.01)

(58) Field of Classification Search
CPC ..... G10H 1/053; G10H 2220/361; G10H 2230/175; G10H 2230/195; G10H 2230/241; G10H 2250/461
USPC ..... 84/626
See application file for complete search history.

(56) References Cited

U.S. PATENT DOCUMENTS 5,069,107 A * 12/1991 Sakashita ..... G10H 1/00 84/665
5,119,712 A * 6/1992 Kato ..... G10H 1/186 84/626
5,125,315 A * 6/1992 Kawashima ..... G10H 1/20 84/657
5,300,729 A * 4/1994 Tokunaga ..... G10H 1/18 84/657
5,922,985 A * 7/1999 Taniwaki ..... G10H 1/34 84/742
5,929,361 A * 7/1999 Tanaka ..... G10H 1/055 84/742

(Continued)

FOREIGN PATENT DOCUMENTS

CN 105989821 A * 10/2016 ..... G10H 1/055
JP S60004994 1/1985

(Continued)

*Primary Examiner* — Christina M Schreiber
(74) *Attorney, Agent, or Firm* — JCIPRNET

(57) ABSTRACT

An electronic wind instrument and a control method thereof are provided. The electronic wind instrument includes an acquisition unit which acquires an operation performed on a playing operator, a breathing detection unit which detects breathing, and a control unit which generates a musical sound signal on the basis of at least one of the breathing that has been detected and the operation acquired by the acquisition unit, in which the control unit switches a first mode for generating a musical sound signal with a detection of the breathing as a condition and a second mode for generating the musical sound signal on the basis of the operation regardless of whether or not the breathing has been detected, on the basis of a detection result of the breathing.

17 Claims, 6 Drawing Sheets

(56) References Cited

U.S. PATENT DOCUMENTS 6,002,080 A * 12/1999 Tanaka ..... G10H 1/34 84/649
D931,932 S * 9/2021 Matsumura ..... D17/13
2007/0144336 A1* 6/2007 Fujii ..... G10H 1/0008 84/723
2008/0072746 A1* 3/2008 Shibata ..... G10H 1/0008 84/671
2012/0017749 A1* 1/2012 Hashimoto ..... G10H 1/053 84/600
2012/0073424 A1* 3/2012 Hashimoto ..... G10H 1/0008 84/622
2016/0275930 A1* 9/2016 Harada ..... G10H 1/32
2018/0075831 A1* 3/2018 Toyama ..... G10H 3/16
2018/0082664 A1* 3/2018 Sasaki ..... H03H 7/01
2018/0218720 A1* 8/2018 Smith ..... G10H 3/16
2018/0268791 A1* 9/2018 Okuda ..... G10H 1/0551
2019/0019485 A1* 1/2019 Toyama ..... G10H 1/0008
2019/0096374 A1* 3/2019 Harada ..... G10H 1/0551
2020/0005752 A1* 1/2020 Davey ..... G10H 3/125
2020/0372888 A1* 11/2020 Sasaki ..... G10H 3/143
2021/0065666 A1* 3/2021 Terada ..... G10H 1/053
2021/0074252 A1* 3/2021 Hirose ..... G10H 1/053
2021/0090534 A1* 3/2021 Tabata ..... G06F 3/165
2021/0201873 A1* 7/2021 Sato ..... G10H 1/34
2021/0272544 A1* 9/2021 Kashiwase ..... G10H 1/047
2021/0304714 A1* 9/2021 Miyazaki ..... H04R 1/028
2021/0312896 A1* 10/2021 Sato ..... G10H 1/32

FOREIGN PATENT DOCUMENTS

JP 2017062327 A * 3/2017
JP 2018155792 A * 10/2018 ..... G10H 1/0008
JP 2018156057 A * 10/2018 ..... G10H 1/0008
JP 2019061085 A * 4/2019 ..... G10H 1/02
JP 6801533 B2 * 12/2020 ..... G10H 1/0008

* cited by examiner

ELECTRONIC WIND INSTRUMENT AND CONTROL METHOD THEREOF

CROSS-REFERENCE TO RELATED APPLICATION

This application claims the priority of Japan patent application serial no. 2019-163296, filed on Sep. 6, 2019. The entirety of the above-mentioned patent application is hereby incorporated by reference herein and made a part of this specification.

BACKGROUND

Technical Field

The present disclosure relates to an electronic wind instrument and control method thereof.

Description of Related Art

An electronic wind instrument that detects an air flow when a player blows with a breath sensor, and generates a musical sound signal, and controls a sound volume on the basis of a detected breath flow rate is known. In a general electronic wind instrument, a sound volume is controlled in accordance with a breath flow rate, and a pitch is controlled according to the playing of the operator.

On the other hand, there is a demand for allowing breathing by a player to be omitted in order to reduce the effort required of a player when producing a sound. As an invention handling this, for example, Patent Document 1 discloses an electronic wind instrument capable of maintaining an output signal of a breath sensor. In this electronic wind instrument, it is possible to maintain a sound production state by pressing a hold switch during sound production.

PATENT DOCUMENTS

[Patent Document 1] Japanese Patent Laid-Open No. S60-004994

According to the invention disclosed in Patent Document 1, since an output signal of a breath sensor can be held, it is possible to continuously produce a sound without performing breathing while a holding function is valid.

However, the Patent Document 1 only holds the output of a breath sensor, and thus breathing is required to start sound production. In addition, it is necessary to turn off a holding switch in order to cancel holding, which causes a problem that an operation becomes complicated.

SUMMARY

According to an embodiment, an electronic wind instrument includes an acquisition unit which acquires an operation performed on a playing operator, a breathing detection unit which detects breathing, and a control unit which generates a musical sound signal on a basis of at least one of the breathing that has been detected and the operation acquired by the acquisition unit, in which the control unit switches to a first mode for generating the musical sound signal with a detection of the breathing as a condition and a second mode for generating the musical sound signal on a basis of the operation regardless of whether or not breathing has been detected, on the basis of a result of detecting breathing.

DESCRIPTION OF THE EMBODIMENTS

The disclosure provides an electronic wind instrument in which the necessity for breathing can be switched to or from with a simple operation.

An electronic wind instrument according to the present embodiment is a device (electronic musical instrument) that stores a sound source, generates a musical sound signal on the basis of breathing and an operation on a playing operator performed by a player, and outputs the generated musical sound signal as a sound.

Figure 1:
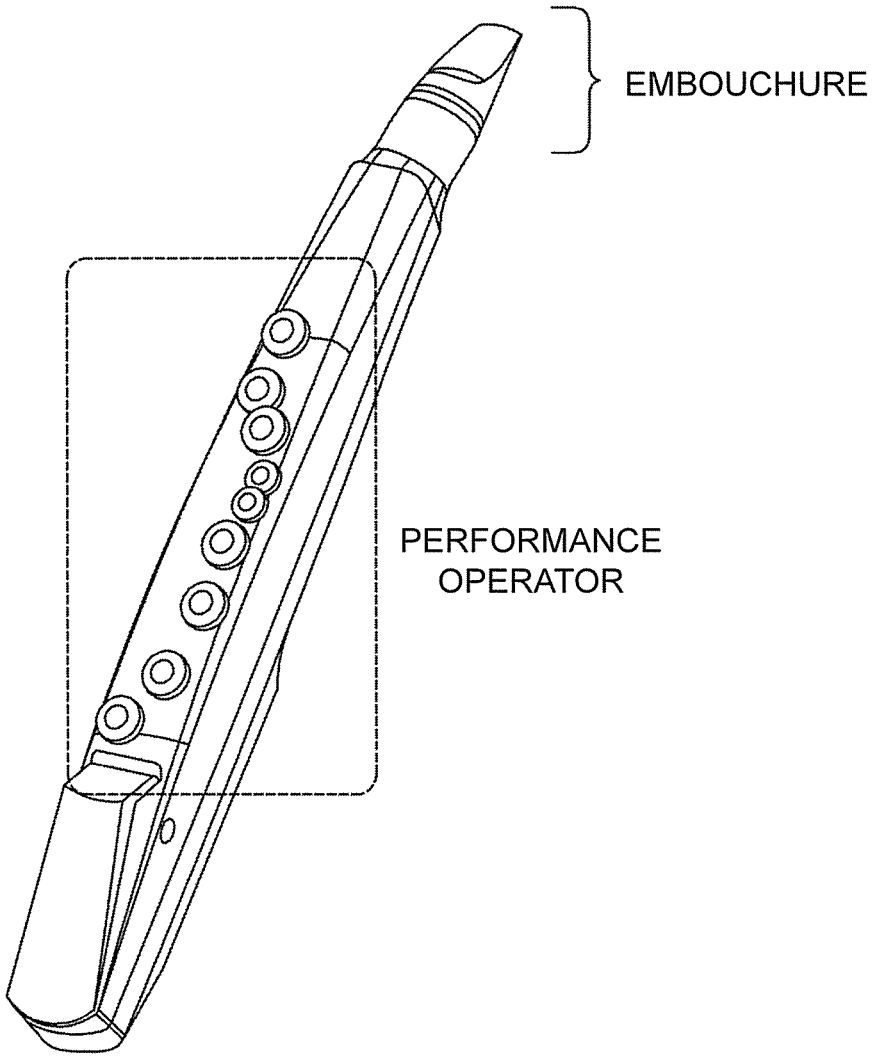
FIG. 1 is a diagram showing the appearance of an electronic wind instrument 100.

FIG. 1 shows a diagram showing the appearance of an electronic wind instrument 100 according to the present embodiment.

The electronic wind instrument 100 according to the present embodiment is an electronic musical instrument that imitates a wind instrument. Specifically, the electronic wind instrument includes an embouchure having a breath sensor built thereinto, a playing operator, and a unit that generates a musical sound, generates a musical sound signal having a timbre of a wind instrument such as a saxophone, a trumpet, or a flute on the basis of breathing and a playing operation performed by a player, and emits a sound from a speaker.

An electronic wind instrument according to the related art generally adopts a configuration in which a sound volume of a musical sound signal is determined on the basis of a flow rate and pressure of breathing performed by a player. In addition, there is also a product capable of validating a holding function (a function of imitating continuous breathing) on the basis of a predetermined operation. The holding function can be realized, for example, by storing a breath pressure at the moment when a holding button is pressed and generating a musical sound signal on the assumption that breathing continues at that pressure.

However, when a configuration in which the validation and invalidation of a holding function are switched between by a button operation is adopted, an operation becomes complicated. A musical scale of a wind instrument is determined according to fingering of both hands, and thus it is preferable that an operation not directly related to a playing be not performed with the fingers. The electronic wind instrument 100 according to the present embodiment solves this problem by switching between the validation and invalidation of a holding function on the basis of only breathing.

Figure 2:
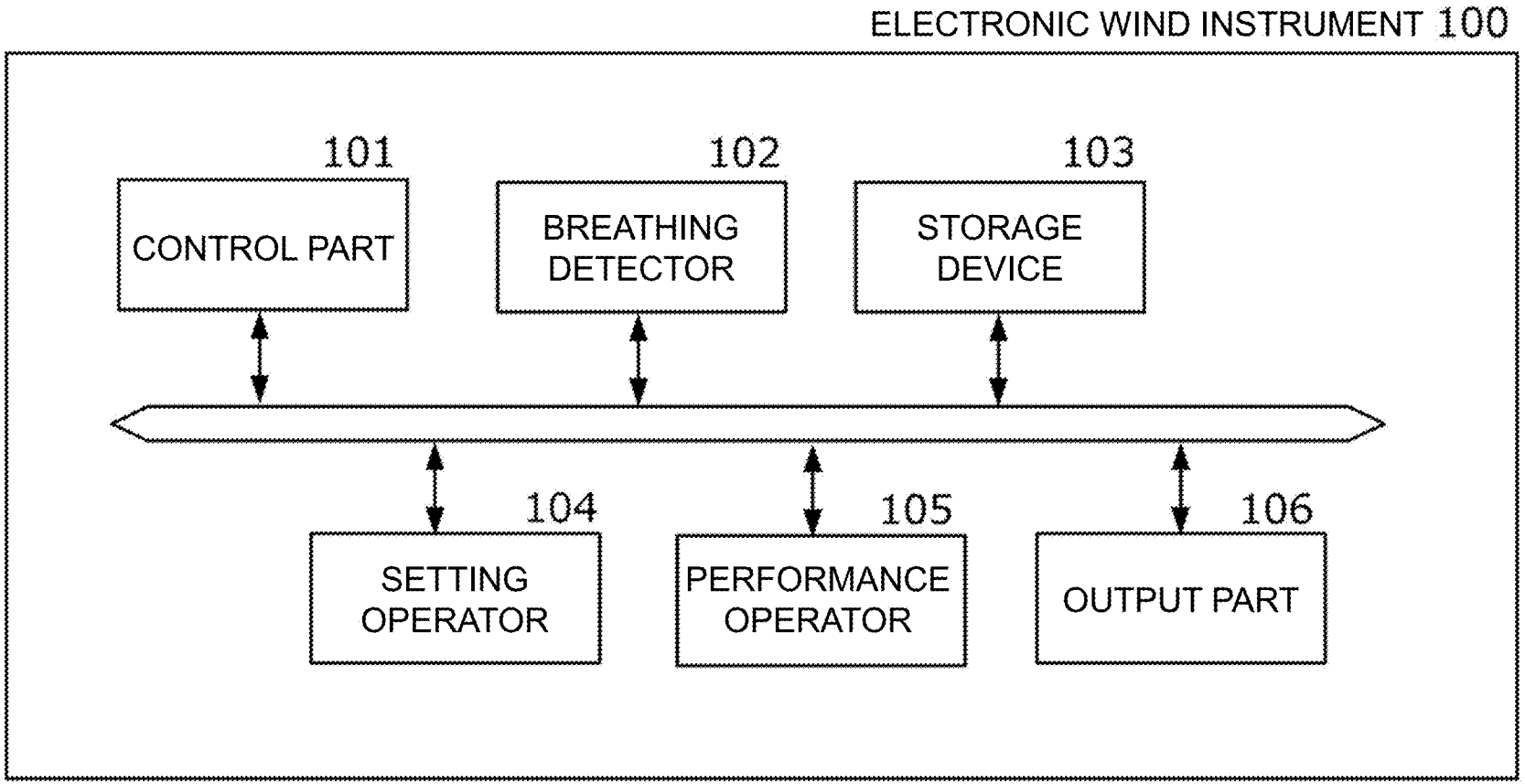
FIG. 2 is a hardware configuration diagram of the electronic wind instrument 100.

A hardware configuration of the electronic wind instrument 100 will be described with reference to FIG. 2.

The electronic wind instrument 100 includes a control part 101, a breathing detector 102, a storage device 103, a setting operator 104, a playing operator 105, and an output part 106. These means are driven by power supplied from a charging type battery.

The control part 101 is an arithmetic calculation device that controls the electronic wind instrument 100. The control part 101 is constituted by, for example, a central processing unit (CPU) or the like.

The breathing detector 102 is means for detecting a player's breath. The breathing detector 102 includes a sensor that detects a flow rate of blown-in air and outputs an electrical signal of a voltage based on a detection result, and an A/D converter that converts the electrical signal into a digital signal. Meanwhile, the detection of breathing may be performed by measuring a flow rate of air per unit time or may be performed by measuring air pressure. For example, a breath flow rate may be indirectly acquired by detecting an air pressure inside an embouchure.

The storage device 103 includes a rewritable non-volatile memory (RAM). The storage device 103 stores a control program executed in the CPU 101 and data used by the control program. A program stored in the storage device 103 is loaded and executed by the control part 101, so that processing to be described below is performed.

Meanwhile, in the present example, a combination of the CPU and the RAM has been described, but all or some of functions shown in the drawings may be executed using a circuit designed exclusively therefor. In addition, a program may be stored and executed by a combination of a main storage device and an auxiliary storage device that are not shown in the drawings.

The setting operator 104 is an interface for setting parameters for performing a playing, and the like. The setting operator 104 includes switches for performing setting of, for example, a timbre, a master volume, a transposition, a chorus level, and a reverb level, and the like. These pieces of information set by the setting operator 104 will be hereinafter referred to as musical sound parameters.

The playing operator 105 is an interface for designating a pitch of a musical sound signal. The playing operator 105 includes, for example, a plurality of keys based on a key array of a recorder. An operation performed by the playing operator 105 (that is, a key pressing operation for designating a pitch) will be hereinafter referred to as a playing operation.

The output part 106 is means for outputting a musical sound signal generated by the control part 101. Specifically, the output part includes a D/A converter, an amplifier, a speaker, and the like.

Next, processing performed by the control part 101 will be described.

Figure 3:
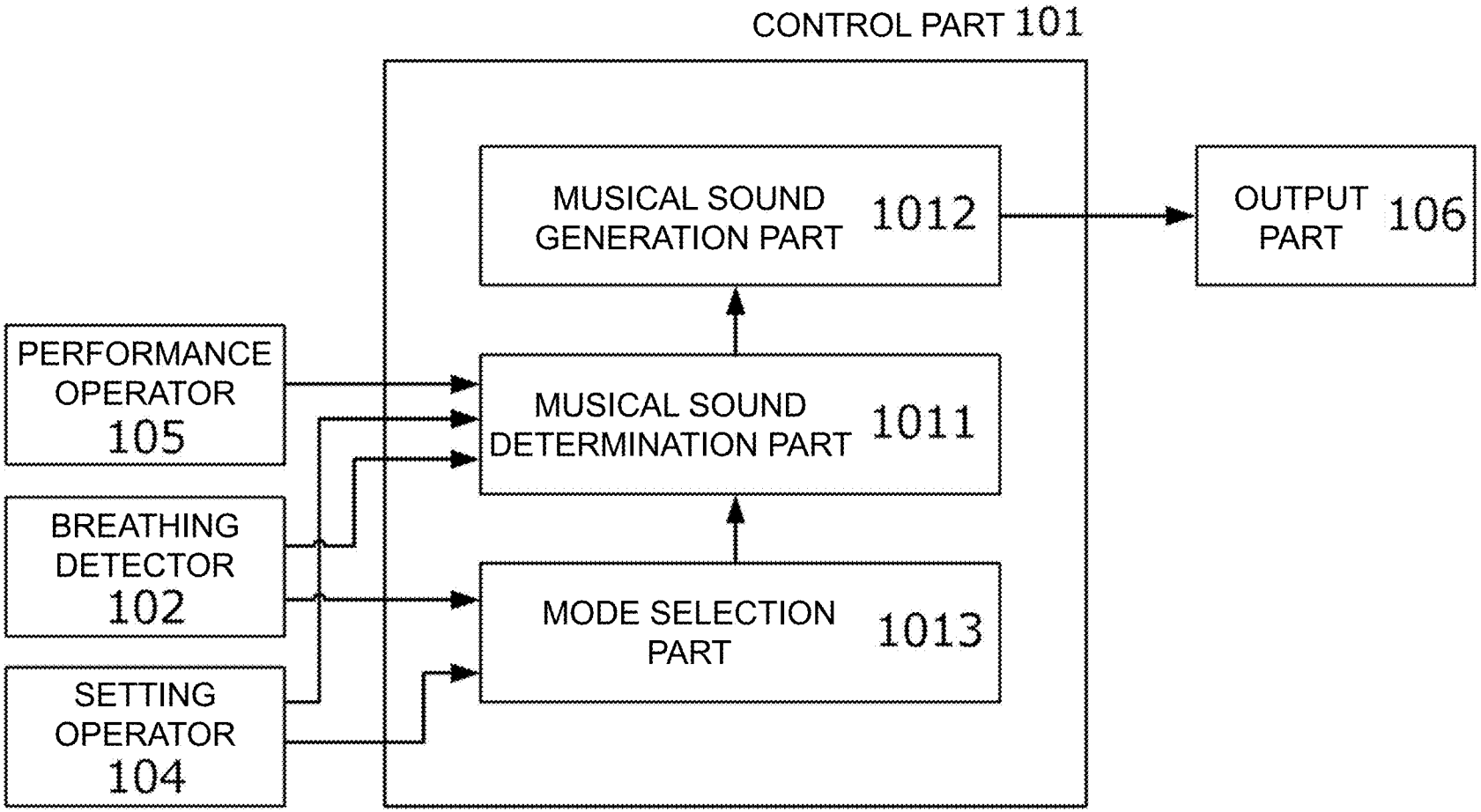
FIG. 3 is a software functional block diagram of a control part 101.

FIG. 3 is a functional block diagram showing processing executed by the control part 101 included in the electronic wind instrument 100. The control part 101 includes three parts, that is, a musical sound determination part 1011, a musical sound generation part 1012, and a mode selection part 1013, as functional blocks.

The musical sound determination part 1011 determines a musical sound to be generated, on the basis of an operation performed by a player. Specifically, a timbre, a musical scale, a sound volume, and the like of a musical sound to be played are determined on the basis of (1) a breath flow rate acquired by the breathing detector 102, (2) details of a playing operation acquired by the playing operator 105 (which key has been pressed), (3) details of musical sound parameters set by the setting operator 104, and the like.

The details determined by the musical sound determination part 1011 are transmitted to the musical sound generation part 1012. Communication between the musical sound determination part 1011 and the musical sound generation part 1012 may be performed by a MIDI interface. In this case, control messages based on an MIDI standard (a note-on signal, a note-off signal, control change, program change, and the like) are transmitted and received between the musical sound determination part 1011 and the musical sound generation part 1012. In the following description, a mode using an MIDI interface will be described.

The musical sound determination part 1011 is operated in accordance with a mode designated by the mode selection part 1013 to be described later. Specifically, the musical sound determination part is operated in accordance with either a first mode for generating a musical sound signal on the basis of both breathing and a playing operation or a second mode for generating a musical sound signal according to only a playing operation other than breathing.

In a case where the first mode is designated as an operation mode, the musical sound determination part 1011 transmits a control message to the musical sound generation part 1012 so that a musical sound having a pitch according to a playing operation is generated with a sound volume based on a breath flow rate.

In a case where a second mode is designated as an operation mode, the musical sound determination part 1011 transmits a control message to the musical sound generation part 1012 so that a musical sound having a pitch according to a playing operation is generated with a predetermined sound volume.

Further, in the first mode, the musical sound determination part 1011 generates a note-on signal in a case where a breath flow rate exceeds a predetermined value and generates a note-off signal in a case where a breath flow rate is less than the predetermined value. On the other hand, in the second mode, the musical sound determination part 1011 generates a note-on signal in a case where at least any one of the plurality of keys included in the playing operator 105 is pressed, and generates a note-off signal in a case where the pressed key is released.

The musical sound generation part 1012 synthesizes musical sound signals through software processing on the basis of a control message (MIDI message) received from the musical sound determination part 1011 and outputs the synthesized signals to the output part 106. Meanwhile, the musical sound generation part 1012 may generate a musical sound signal through only software processing or may generate a musical sound signal using a sound source constituted by hardware.

The mode selection part 1013 selects either one of the first mode and the second mode on the basis of a result indicating whether or not breathing has been performed, which is acquired by the breathing detector 102. Specifically, it is determined in which mode out of the first mode and the second mode an operation is performed on the basis of results obtained by detecting whether or not breathing has been performed within a predetermined period, and the musical sound determination part 1011 is given an instruction.

Meanwhile, a mode is switched on the basis of whether or not breathing has been performed in the present embodiment, but a mode may be fixed. For example, in a case where a user performs an operation of fixing a mode through the setting operator 104, the mode selection part 1013 may fix a mode to either one of the first mode and the second mode in accordance with the operation.

Figure 4:
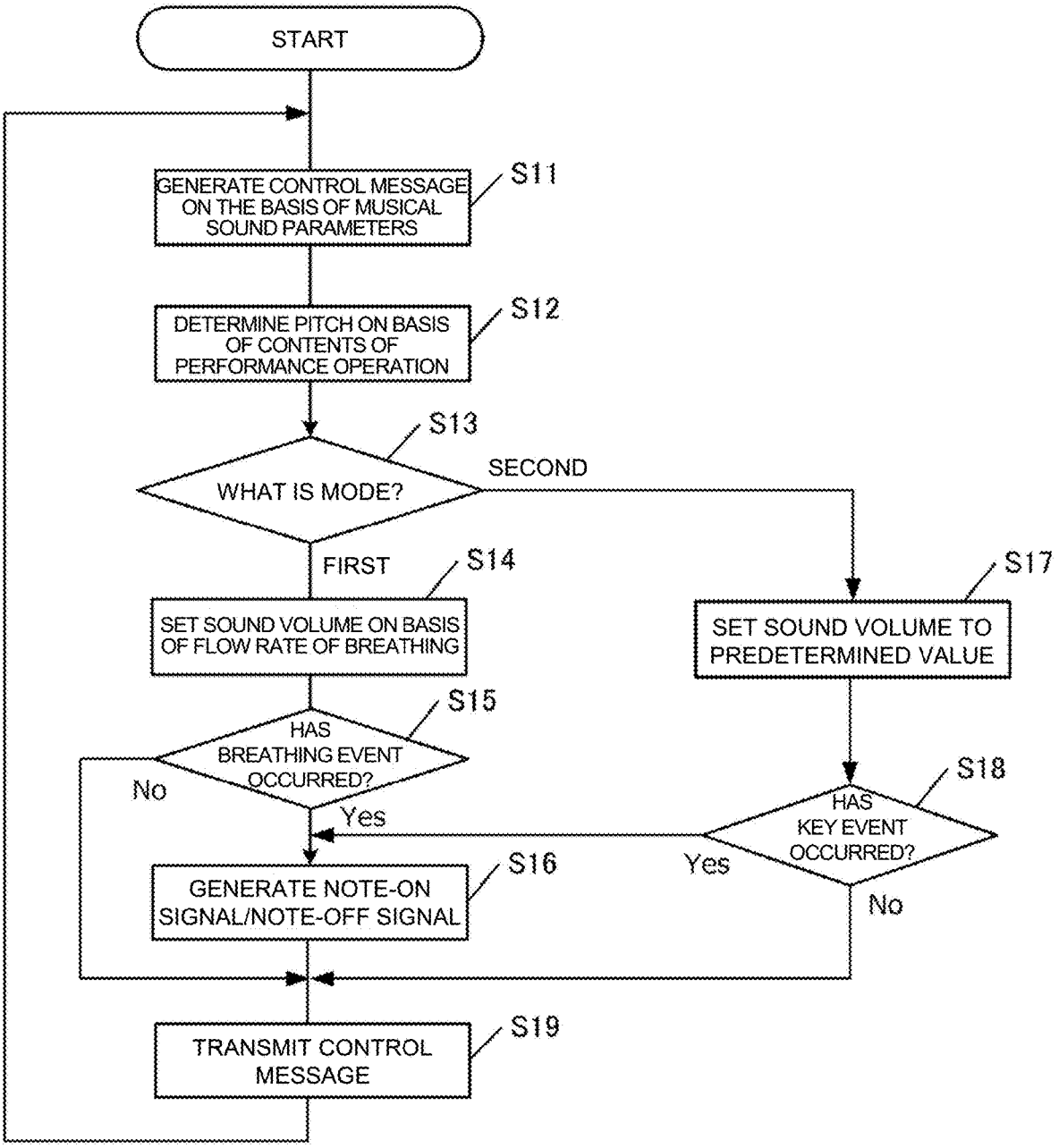
FIG. 4 is a flowchart of processing performed by a musical sound determination part.

Next, a flowchart of processing performed by the musical sound determination part 1011 will be described with reference to FIG. 4. An operation shown in FIG. 4 is started at a timing when a power supply of a musical instrument is turned on.

First, in step S11, a control message to be transmitted to the musical sound generation part 1012 is generated on the basis of musical sound parameters that are set through the setting operator 104. In the present step, a control message (for example, program change or control change) for designating a timbre, an effect (chorus, reverb, or the like), or the like is generated. Meanwhile, in a case where musical sound parameters have not changed from the previous processing, the present step may be omitted.

Next, in step S12, a pitch of a musical sound to be produced is determined on the basis of an operation performed on the playing operator 105 by a player (playing operation). It is preferable that conversion from a playing operation to a pitch be performed according to a rule suitable for an actual wind instrument. For example, it is possible to determine a pitch on the basis of a key operation of a recorder.

Meanwhile, in a case where the electronic wind instrument 100 is a transposition musical instrument such as a saxophone and a transposition has been designated by a player, a pitch of a musical sound may be changed in the present step. For example, an alto saxophone and a baritone saxophone are E b tubes, and a soprano saxophone and a tenor saxophone are Bb tubes, but a transposition can be easily performed in an electronic musical instrument. In this case, a transposition may be performed in accordance with a predetermined rule (a combination of a transposition source and a transposition destination).

Next, in step S13, a designated mode is determined. Here, in a case where the first mode is designated by the mode selection part 1013, the processing proceeds to step S14.

In step S14, a breath flow rate performed by the player is acquired from the breathing detector 102, and a control message for designating a sound volume of a musical sound is generated on the basis of the flow rate. Conversion from a flow rate (absolute value) to a sound volume can be performed, for example, with reference to a table stored in advance, a numerical formula, or the like.

Next, in step S15, it is determined whether or not a breathing event has occurred. The breathing event is an even that occurs in a case where there is a change from a state where breathing is performed to a state where breathing is not performed and there is a change from a state where breathing is not performed to a state where breathing is performed. Here, in a case where it is determined that breathing has been started, a note-on signal is generated in step S16. Further, in a case where it is determined that breathing has been terminated, a note-off signal is generated in step S16. Whether or not breathing has been performed can be determined by comparing a breath flow rate acquired from the breathing detector 102 with a predetermined threshold value. Meanwhile, in a case where the note-on signal generated in step S16 is accompanied by the designation of a sound volume, the sound volume may be determined on the basis of a breath flow rate.

In a case where a breathing event has not occurred, the processing proceeds to step S19.

In step S13, in a case where the second mode is designated by the mode selection part 1013, the processing proceeds to step S17.

In step S17, a control message for setting a sound volume of a musical sound to a predetermined value is generated. The predetermined value can be set to be, for example, a value set by a player in advance. Since the second mode is a mode for producing a sound independently of breathing, it is preferable that a sound volume desired by the player be able to be set in advance.

Next, in step S18, it is determined whether or not a key event has occurred. The key event is an event occurring when an operation of pressing a key of a playing operator and an operation of releasing a key have occurred. Here, in a case where it is determined that a key has been pressed, the processing proceeds to step S16 to generate a note-on signal. Further, in a case where it is determined that a key has been released, a note-off signal is generated in step S16.

In a case where a key event has not occurred, the processing proceeds to step S19.

In step S19, the generated control message is transmitted to the musical sound generation part 1012. Specifically, the control message generated in step S11, the control messages for designating a sound volume determined in steps S14 and S17, and the note-on signal or the note-off signal generated in step S16 are transmitted. Thereby, a musical sound signal is generated by the musical sound generation part 1012.

Figure 5:
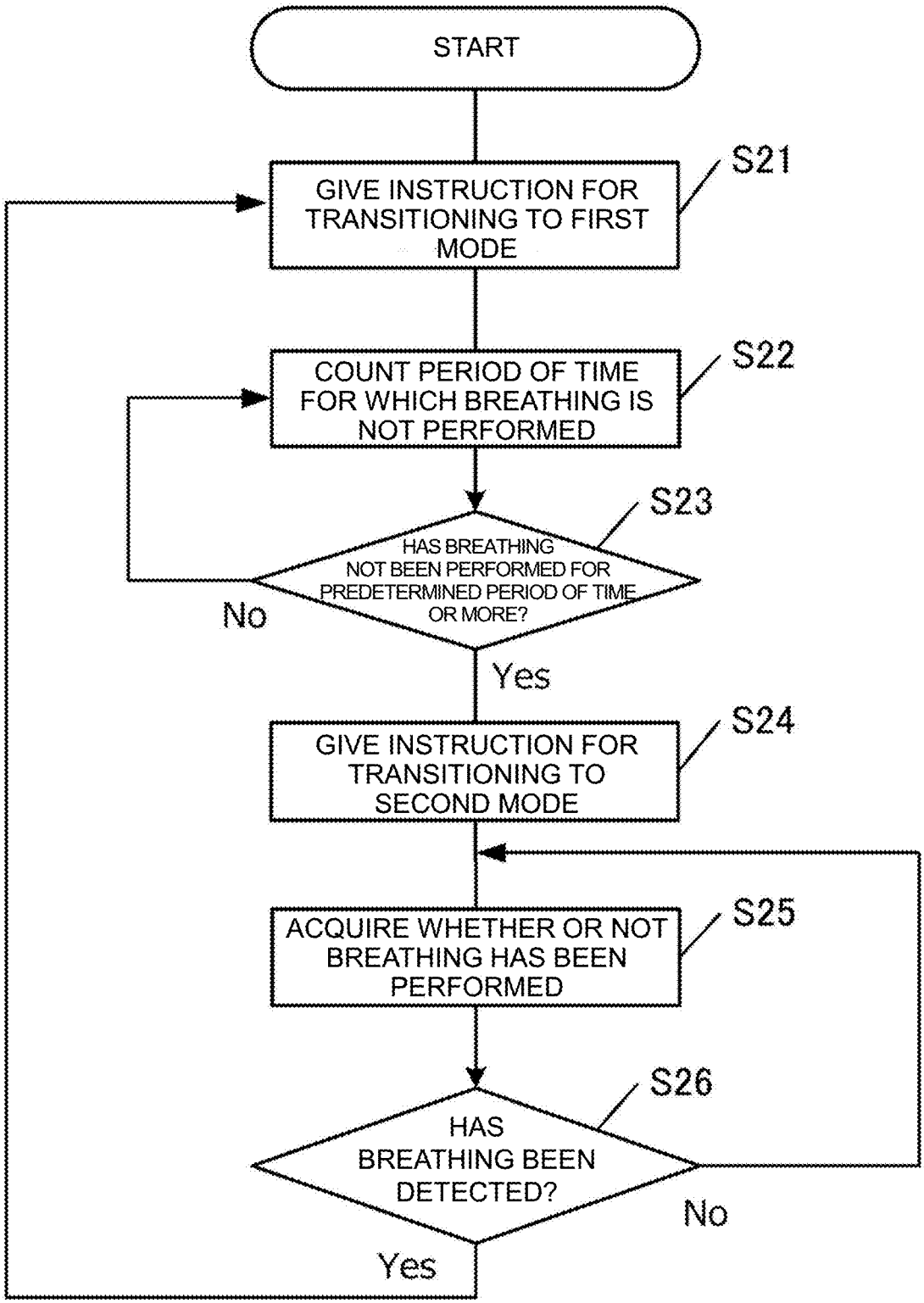
FIG. 5 is a flowchart of processing performed by a mode selection part.

Next, a flowchart of processing performed by the mode selection part 1013 will be described with reference to FIG. 5. An operation shown in FIG. 5 is started at a timing when a power supply of a musical instrument is turned on.

First, in step S21, the musical sound determination part 1011 is instructed to transition to the first mode.

Next, in step S22, a period of time for which breathing is not performed is counted on the basis of information acquired from the breathing detector 102. A counter is incremented whenever a predetermined period of time elapses and is reset at a timing when breathing is detected. For example, in a case where the predetermined period of time is one second, the count is the number of seconds for which breathing has not been performed.

Next, in step S23, it is determined whether or not the period of time for which breathing has not been performed has exceeded a predetermined period of time (for example, five seconds). Here, in a case where a determination result is affirmative, the processing proceeds to step S24. In a case where a determination result is negative, the processing returns to step S22 to continue counting.

In a case where the determination result in step S23 is affirmative, that is, it is determined that breathing has not been performed for a predetermined period of time or more, the musical sound determination part 1011 is instructed to transition to the second mode in step S24.

In step S25, it is determined whether or not breathing has been performed by a player on the basis of the information acquired from the breathing detector 102. Here, in a case where breathing has been detected (step S26—Yes), the processing returns to step S21, and the musical sound determination part 1011 is instructed to transition to the first mode. In a case where breathing has not been detected, the processing returns to step S25 to continue in the second mode.

As described above, the electronic wind instrument according to the present embodiment transitions to a mode in which a sound can be produced without breathing in a case where breathing has not been performed for a predetermined period of time or more, and transitions to the original mode (a mode in which breathing is required for sound production) in a case where breathing has been detected.

According to such a configuration, it is possible to change a mode without performing switching or a key operation. That is, a mode can be changed while holding a musical instrument with both hands, and thus the convenience for the player is greatly improved.

Second Embodiment

In the first embodiment, it is determined in steps S22 to 23 that breathing is not performed for a predetermined period of time or more, and transition to the second mode is performed with the determination as a trigger. On the other hand, a second embodiment is an embodiment in which breathing is used for a trigger for performing transition to a second mode A hardware configuration and a module configuration of an electronic wind instrument 100 in the second embodiment are the same as those in the first embodiment, and thus detailed description will be omitted, and only differences will be described.

Figure 6:
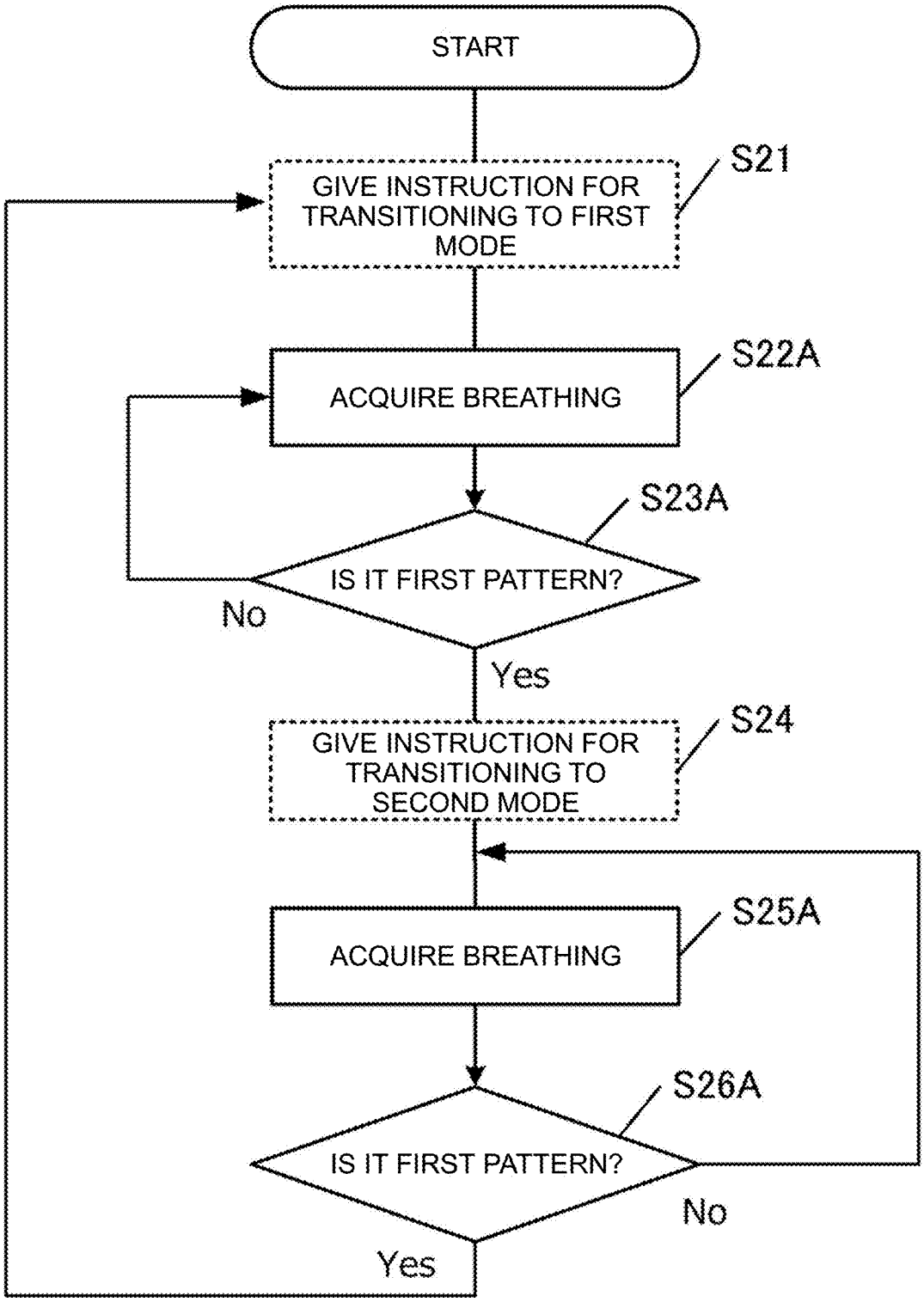
FIG. 6 is a flowchart of processing performed by a mode selection part in a second embodiment.

FIG. 6 is a flowchart of processing performed by the mode selection part 1013 in the second embodiment. In the second embodiment, in step S22A, a change in a breath flow rate performed within a predetermined period (a change in a flow rate with respect to the elapse of time) is acquired. Further, in step S23A, it is determined whether or not the acquired change in a breath flow rate matches a first pattern. Meanwhile, a pattern in the present embodiment may be any pattern as long as the pattern represents a time-series change in a breath flow rate. For example, the pattern may be "blowing once", "blowing twice in a row", "inhaling once", or the like. Here, in a case where an acquired pattern matches the first pattern, the processing proceeds to step S24.

In addition, also in step S25A, a change in a breath flow rate performed within a predetermined period is acquired. In step S26A, it is determined whether or not the acquired change in a breath flow rate matches a second pattern. Here, in a case where the acquired pattern matches the second pattern, the processing proceeds to step S21. The first pattern and the second pattern may be the same pattern or may be different patterns. For example, the second pattern may be "blowing once" similar to the first embodiment, and the first pattern may be "blowing twice in a row".

In the second embodiment, in this manner, switching between the first mode and the second mode is performed by performing a gesture through breathing. According to this embodiment, transition to the second mode can be performed without waiting for the elapse of a predetermined period of time, and thus the convenience for a player is improved.

Third Embodiment

In the first embodiment, as described in step S17, a sound volume in the second mode is set to a predetermined value. On the other hand, a third embodiment is an embodiment in which a sound volume after transition to a second mode is determined on the basis of a breath flow rate acquired in a period in a first mode.

In the third embodiment, a musical sound determination part 1011 determines a sound volume in the second mode on the basis of a breath flow rate performed during the first mode (for example, a breath flow rate acquired in step S14). As the sound volume, for example, a value immediately before transition to the second mode may be used, or a representative value in the first mode (for example, an average value or a maximum value) may be used. For example, a representative value of a sound volume may be determined and temporarily stored during a playing in the first mode, transition to the second mode may be performed, and then the representative value may be set to a sound volume in step S17.

According to the third embodiment, even after transition to the second mode is performed, a playing using a musical instrument can be continuously performed with an appropriate sound volume according to a playing environment.

Modification Example

The above-described embodiments are merely examples, and the disclosure can be appropriately modified and implemented without departing from the scope thereof.

For example, "breathing is performed", "breathing is not performed for a predetermined period of time", and "breathing matching a predetermined pattern is performed" have been described in the embodiments as conditions for performing transition between modes, but transition between modes may be performed with any condition other than the described conditions as a trigger as long as it can be expressed through breathing by a player.

Further, although an electronic musical instrument imitating a wind instrument such as a recorder, a saxophone, a trumpet, or a flute has been described in the embodiments, an embodiment as an electronic musical instrument except for a wind instrument is also conceivable. For example, the embodiment may be a keyboard harmonica, an accordion, or the like. In addition, the embodiment may be implemented as an electronic musical instrument that outputs a sound sampled by a user or a sound obtained by processing the sampled sound. In this case, the electronic musical instrument produces a sound on the basis of breathing, but the electronic musical instrument is not required to be an instrument imitating a wind instrument.

Further, an example in which a musical sound signal is generated on the basis of breathing has been described in the embodiments, but breathing may be replaced with other operations as long as the operations are not an operation performed with fingers. For example, the breathing detector 102 may be replaced with a sound detector, and a musical sound signal may be generated on the basis of a magnitude of a detected sound. In this manner, an embodiment incorporating elements of a vocoder is also conceivable.

Further, in a case where switching between modes has occurred, a predetermined control message may be transmitted from the musical sound determination part 1011 to the musical sound generation part 1012. For example, in a case where transition from the first mode to the second mode has occurred, a control message for switching from a first timbre to a second timbre may be generated and transmitted. This is the same as in a reversed case. According to such a configuration, a musical sound suitable for each mode can be generated.

A breath is breathing of a player.

The first mode is a playing mode for generating a musical sound signal with the detection of breathing as a requirement. In the first mode, a musical sound signal is generated and output with a sound volume according to a flow rate of the detected breathing, and the output of a musical sound signal is also stopped when breathing is stopped. In addition, the second mode is a playing mode for generating a musical sound signal on the basis of an operation performed on the playing operator without the detection of breathing as a requirement. In the second mode (also referred to as a holding mode), a musical sound signal is generated with a pitch designated by the playing operator regardless of whether or not breathing has been performed.

The control unit can switch between the first mode (normal mode) and the second mode (holding mode) in accordance with a result of detecting breathing, for example, whether or not blowing-in has been performed for a predetermined period of time, whether or not inhalation has been performed, or the like. When a configuration in which modes can be switched between with breathing as a trigger is adopted, a mode can be freely switched to while holding a musical instrument with both hands, that is, taking a playing posture.

In addition, the control unit may switch a mode to the first mode in a case where a current mode is the second mode and the breathing detection unit has detected breathing.

In a case where a player desires to produce a sound through breathing, transition to the first mode is performed by performing breathing. Thereby, a mode can be switched immediately. After transition to the first mode is performed, a sound is produced in accordance with a breath flow rate, and thus a playing can be smoothly continued.

In addition, the control unit may switch a mode to the second mode in a case where a current mode is the first mode and a state where the breathing detection unit has not detected the breathing has continued for a predetermined period of time or more.

In this manner, in a case where breathing has not been performed for a predetermined period of time or more, transition to a playing mode without breathing as a requirement may be performed. Also, in this case, when a player desires to produce a sound through breathing, transition to the first mode is immediately performed by performing breathing. That is, it is possible to perform transition between modes without disturbing the player's intention.

In addition, in a period in the first mode, the control unit may switch a mode to the second mode in a case where the breathing that has been detected matches a first pattern, and in a period in the second mode, the control unit may switch a mode to the first mode in a case where the breathing that has been detected matches a second pattern.

In this manner, an instruction for switching a mode may be given on the basis of a pattern of breathing. The pattern can be defined by, for example, the number of times of blowing-in and inhalation, the number of seconds when stopped, a combination thereof, or the like.

In addition, the control unit may set a sound volume of the musical sound signal in the second mode on the basis of a breath flow rate detected in a certain period in the first mode.

In this manner, a sound volume during a holding mode may be set on the basis of a breath flow rate before transition to the holding mode. According to such a configuration, a playing can be made with an appropriate sound volume according to an environment.

Meanwhile, the disclosure can be specified as an electronic wind instrument including at least some of the above-described means. In addition, the disclosure can also be specified as a control method of electronic wind instrument. In addition, the disclosure can also be specified as a program for executing the control method. The above-described processing and means can be freely implemented in combination with each other as long as there are no technical contradictions.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An electronic wind instrument comprising:

an acquisition unit which acquires an operation performed on a playing operator;

a breathing detection unit which detects breathing; and a control unit which generates a musical sound signal on a basis of at least one of the breathing that has been detected and the operation acquired by the acquisition unit, wherein the control unit switches to a first mode and a second mode on a basis of a detection result of the breathing, the first mode is for generating the musical sound signal with a detection of the breathing as a condition and the second mode is for generating the musical sound signal on a basis of the operation.

2. The electronic wind instrument according to claim 1, wherein the control unit switches a mode to the first mode in a case where a current mode is the second mode and the breathing detection unit has detected the breathing.

3. The electronic wind instrument according to claim 2, wherein the control unit switches a mode to the second mode in a case where a current mode is the first mode and the breathing detection unit has not detected the breathing continues for a predeteiniined period of time or more.

4. The electronic wind instrument according to claim 1, wherein the control unit switches a mode to the second mode in a case where a current mode is the first mode and the breathing detection unit has not detected the breathing for a predetermined period of time or more.

5. The electronic wind instrument according to claim 1, wherein in a period in the first mode, the control unit switches a mode to the second mode in a case where the breathing that has been detected matches a first pattern, and in a period in the second mode, the control unit switches a mode to the first mode in a case where the breathing that has been detected matches a second pattern.

6. The electronic wind instrument according to claim 1, wherein the control unit sets a sound volume of the musical sound signal in the second mode on a basis of a breath flow rate detected in a period in the first mode.

7. An electronic wind instrument control method, wherein the electronic wind instrument comprises a playing operator and a breathing sensor, the electronic wind instrument control method comprising:

an acquisition step of acquiring an operation performed on the playing operator;

a breathing detection step of detecting breathing; and a control step of generating a musical sound signal on a basis of at least one of the breathing that has been detected and the operation acquired in the acquisition step, wherein in the control step, a first mode and a second mode are switched on a basis of a detection result of the breathing, the first mode is for generating the musical sound signal with a detection of the breathing as a condition and the second mode is for generating the musical sound signal on a basis of the operation.

8. The electronic wind instrument control method according to claim 7, wherein the control step comprises switching a mode to the first mode in a case where a current mode is the second mode and the breathing is detected in the breathing detection step.

9. The electronic wind instrument control method according to claim 8, wherein the control step comprises switching a mode to the second mode in a case where a current mode is the first mode and the breathing detection unit has not detected the breathing for a predetermined period of time or more in the breathing detection step.

10. The electronic wind instrument control method according to claim 7, wherein the control step comprises switching a mode to the second mode in a case where a current mode is the first mode and the breathing detection unit has not detected the breathing for a predetennined period of time or more in the breathing detection step.

11. The electronic wind instrument control method according to claim 7, wherein the control step comprises:

in a period in the first mode, switching a mode to the second mode in a case where the breathing that has been detected matches a first pattern, and in a period in the second mode, switching a mode to the first mode in a case where the breathing that has been detected matches a second pattern.

12. The electronic wind instrument control method according to claim 7, wherein the control step comprises setting a sound volume of the musical sound signal in the second mode on a basis of a breath flow rate detected in a period in the first mode.

13. An electronic wind instrument control method which is a method of controlling an electronic wind instrument that generates a musical sound signal on a basis of a detection result of breathing and an operation of a playing operator, the electronic wind instrument control method comprises:

switching a generation mode of the musical sound signal of the electronic wind instrument based on the detection result of the breathing, and generating a musical sound signal on a basis of the operation of the playing operator.

14. The electronic wind instrument control method according to claim 13, wherein switching the generation mode in a case if the breathing has not been performed for a predetermined period of time or more, and generating the musical sound signal on a basis of the operation of the playing operator.

15. The electronic wind instrument control method according to claim 14, wherein when the breathing has been detected in generating the musical sound signal on a basis of with the operation of the playing operator, the generation mode of the musical sound signal is switched and the musical sound signal is generated on a basis of the detection result of the breathing and the operation of the playing operator.

16. The electronic wind instrument control method according to claim 13, wherein in a case where the detection result of the breathing is determined that the breathing matches a first pattern, the generation of the musical sound signal of the electronic wind instrument is switched to generation of the musical sound signal on a basis of the operation of the playing operator.

17. The electronic wind instrument control method according to claim 16, wherein when the musical sound signal is generated on a basis of the operation of the playing operator, and the detection result of the breathing is determined to match a second pattern, the generation mode of the musical sound signal is switched and the musical sound signal is generated on a basis of the detection result of the breathing and the operation of the playing operator.

* * * * *